US009250581B2

(12) United States Patent
Tokuda

(10) Patent No.: US 9,250,581 B2
(45) Date of Patent: Feb. 2, 2016

(54) FIXING DEVICE AND IMAGE FORMING APPARATUS INCORPORATING SAME

(71) Applicant: Tetsuo Tokuda, Kanagawa (JP)

(72) Inventor: Tetsuo Tokuda, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/529,634

(22) Filed: Oct. 31, 2014

(65) Prior Publication Data

US 2015/0125192 A1 May 7, 2015

(30) Foreign Application Priority Data

Nov. 1, 2013 (JP) ..... 2013-228009
May 13, 2014 (JP) ..... 2014-099282

(51) Int. Cl.
*G03G 15/20* (2006.01)

(52) U.S. Cl.
CPC ..... *G03G 15/2053* (2013.01); *G03G 15/2039* (2013.01)

(58) Field of Classification Search
CPC ..... G03G 15/206; G03G 15/2053
See application file for complete search history.

(56) References Cited

U.S. PATENT DOCUMENTS

| | | | | |
|---|---|---|---|---|
| 2006/0029444 | A1* | 2/2006 | Naito et al. | 399/329 |
| 2008/0226324 | A1* | 9/2008 | Baba et al. | 399/69 |
| 2009/0060550 | A1 | 3/2009 | Seo | |
| 2009/0148206 | A1 | 6/2009 | Yoshikawa | |
| 2009/0245897 | A1 | 10/2009 | Seo et al. | |
| 2013/0142551 | A1 | 6/2013 | Yamano et al. | |
| 2014/0294461 | A1 | 10/2014 | Tokuda et al. | |

FOREIGN PATENT DOCUMENTS

| | | |
|---|---|---|
| JP | 2000-030850 | 1/2000 |
| JP | 2001-135470 | 5/2001 |
| JP | 2005-005019 | 1/2005 |
| JP | 2006-119419 | 5/2006 |
| JP | 2007-178477 | 7/2007 |
| JP | 2007-212988 | 8/2007 |
| JP | 2008-129517 | 6/2008 |
| JP | 2009-058829 | 3/2009 |
| JP | 2009-139674 | 6/2009 |
| JP | 2009-230070 | 10/2009 |
| JP | 2011-039242 | 2/2011 |
| JP | 2011-107247 | 6/2011 |

(Continued)

OTHER PUBLICATIONS

U.S. Appl. No. 14/204,268, filed Mar. 11, 2014.

*Primary Examiner* — Sandra Brase
(74) *Attorney, Agent, or Firm* — Oblon, McClelland, Maier & Neustadt, L.L.P.

(57) ABSTRACT

A fixing device includes an excitation coil, a rotatable heater, and a support shaft. The excitation coil includes a turning end and an extended portion continuous with the turning end. The heater includes a heat generation layer and a thermosensitive magnetic body composed to switch between magnetized and demagnetized states at a Curie temperature to selectively create localized heating areas in the heat generation layer. The support shaft is made of a nonmagnetic material having a lower electrical resistivity than the thermosensitive magnetic body and supports opposed ends of the heater axially along the heater. The support shaft includes a body portion having a largest outer diameter of the support shaft and an end positioned outside the turning end of the excitation coil, and support portions having a smallest outer diameter of the support shaft and supporting the heater.

7 Claims, 3 Drawing Sheets

(56) References Cited

FOREIGN PATENT DOCUMENTS

| | | |
|---|---|---|
| JP | 2011-227293 | 11/2011 |
| JP | 2013-117652 | 6/2013 |
| JP | 2014-016445 | 1/2014 |
| JP | 2014-139613 | 7/2014 |
| JP | 2014-142518 | 8/2014 |
| JP | 2014-197139 | 10/2014 |
| WO | WO 2005/038533 A1 | 4/2005 |

* cited by examiner

FIXING DEVICE AND IMAGE FORMING APPARATUS INCORPORATING SAME

CROSS-REFERENCE TO RELATED APPLICATIONS

This patent application is based on and claims priority pursuant to 35 U.S.C. §119(a) to Japanese Patent Application Nos. 2013-228009, filed on Nov. 1, 2013, and 2014-099282, filed on May 13, 2014, in the Japan Patent Office, the entire disclosure of each of which is hereby incorporated by reference herein.

BACKGROUND

1. Technical Field

Embodiments of the present invention generally relate to a fixing device and an image forming apparatus, and more particularly, to a support mechanism for a heating mechanism of a fixing device employing electromagnetic induction heating.

2. Background Art

Various types of electrophotographic image forming apparatuses are known, including copiers, printers, facsimile machines, and multifunction machines having two or more of copying, printing, scanning, facsimile, plotter, and other capabilities.

Such image forming apparatuses usually form an image on a recording medium according to image data. Specifically, in such image forming apparatuses, for example, a charger uniformly charges a surface of a photoconductor serving as an image carrier. An optical writer irradiates the surface of the photoconductor thus charged with a light beam to form an electrostatic latent image on the surface of the photoconductor according to the image data. A development device supplies toner to the electrostatic latent image thus formed to render the electrostatic latent image visible as a toner image. The toner image is then transferred onto a recording medium directly, or indirectly via an intermediate transfer belt. Finally, a fixing device applies heat and pressure to the recording medium carrying the toner image to fix the toner image onto the recording medium. Thus, the image is formed on the recording medium.

Such a fixing device typically includes a fixing member such as a roller, a belt, or a film, and an opposed member such as a roller or a belt pressed against the fixing member. The toner image is fixed onto the recording medium under heat and pressure while the recording medium is conveyed between the fixing member and the opposed member.

SUMMARY

In one embodiment of the present invention, an improved fixing device is described that includes an excitation coil, a rotatable heater, and a support shaft. The excitation coil generates a magnetic flux and includes a turning end and an extended portion continuous with the turning end. The heater includes a heat generation layer to generate heat with the magnetic flux from the excitation coil and a thermosensitive magnetic body disposed facing the excitation coil via the heat generation layer, composed to switch between magnetized and demagnetized states at a temperature defined by a Curie temperature b to selectively create localized heating areas in the heat generation layer. The support shaft made of a non-magnetic material having a lower electrical resistivity than the thermosensitive magnetic body to support opposed ends of the heater axially along the heater parallel to a direction in which the excitation coil extends. The support shaft includes a body portion and support portions outboard of and continuous with opposed lateral ends of the body portion. The body portion, positioned inside the heater, has a largest outer diameter of the support shaft and an end positioned outside the turning end of the excitation coil. The support portions have a smallest outer diameter of the support shaft different from the largest outer diameter, and support the heater.

Also described is an improved image forming apparatus including an image forming unit to form an image on a recording medium, and the improved fixing device to fix the image on the recording medium.

BRIEF DESCRIPTION OF THE DRAWINGS

A more complete appreciation of the disclosure and many of the attendant advantages thereof will be more readily obtained as the same becomes better understood by reference to the following detailed description of embodiments when considered in connection with the accompanying drawings, wherein.

Figure 1:
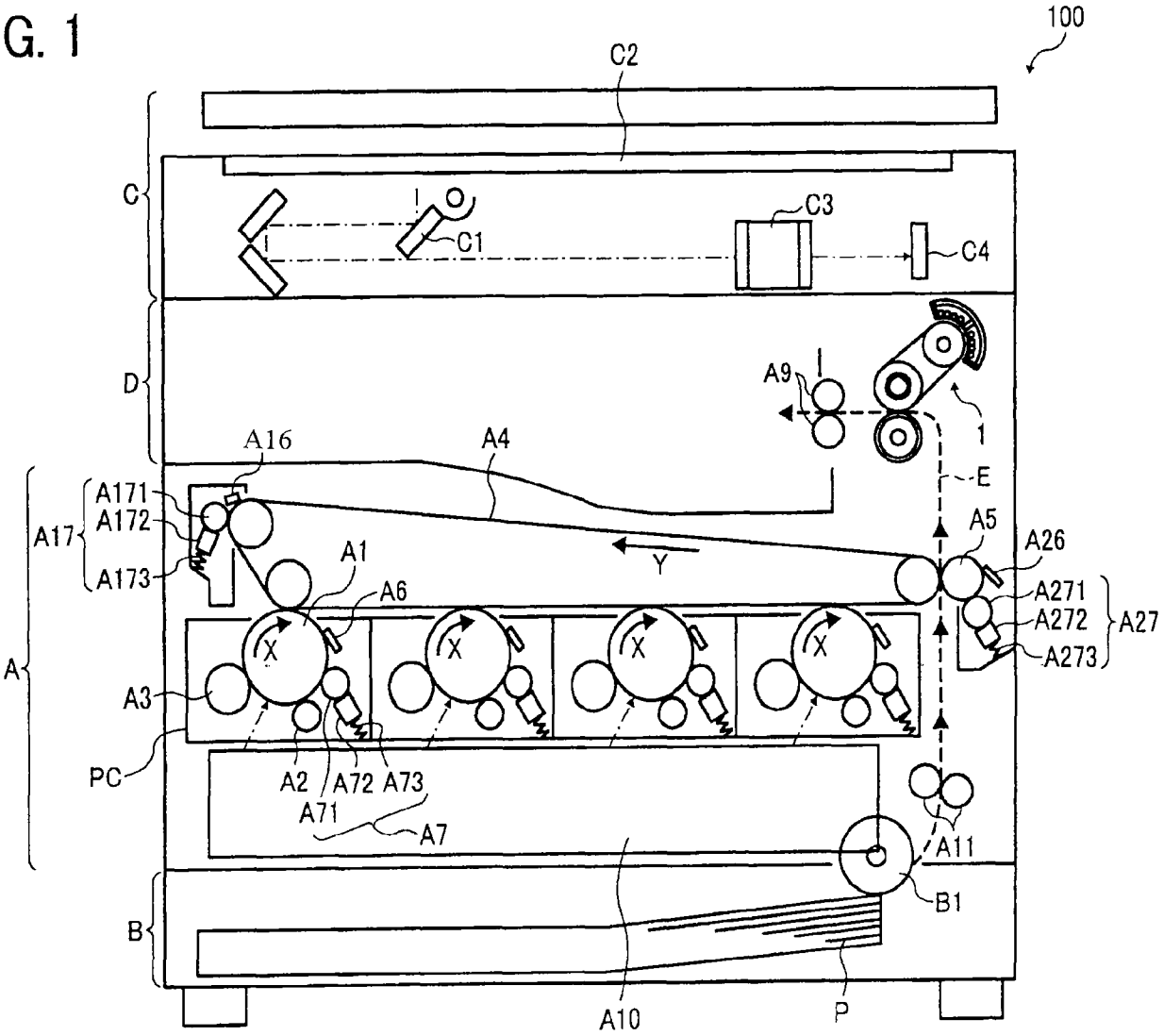
FIG. 1 is a schematic view of an image forming apparatus according to an embodiment of the present invention.

The accompanying drawings are intended to depict embodiments of the present invention and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that have the same function, operate in a similar manner, and achieve similar results.

Although the embodiments are described with technical limitations with reference to the attached drawings, such description is not intended to limit the scope of the invention and all of the components or elements described in the embodiments of the present invention are not necessarily indispensable to the present invention.

In a later-described comparative example, embodiment, and exemplary variation, for the sake of simplicity like reference numerals are given to identical or corresponding constituent elements such as parts and materials having the same functions, and redundant descriptions thereof are omitted unless otherwise required.

Referring now to the drawings, wherein like reference numerals designate identical or corresponding parts throughout the several views, embodiments of the present invention are described below.

Initially with reference to FIG. 1, a description is given of an image forming apparatus 100 according to an embodiment of the present invention.

FIG. 1 is a schematic view of the image forming apparatus 100. In the present embodiment, the image forming apparatus 100 has a configuration of discharging a recording medium P inside its body. The image forming apparatus 100 includes a centrally located image forming unit A, and a feed unit B located below the image forming unit A. It is to be noted that another feed unit may be provided in a lower portion of the image forming apparatus 100 as needed.

The image forming apparatus 100 further includes a discharge unit D located above the image forming unit A, and a scanner C located above the discharge unit D. The discharge unit D receives the recording medium P carrying a toner image. The scanner C reads a document. A recording medium conveyance passage E indicated by the broken line extends from the feed unit B to the discharge tray D.

A detailed description is now given of a construction of the image forming device A. The image forming unit A includes photoconductive drums A1 rotatable in a direction X, each of which is surrounded by components such as a charger A2, an exposure device A10, and a development device A3 for image formation. The charger A2 charges the surface of the photoconductive drum A1. The exposure device A10 irradiates the charged surface of the photoconductive drum A1 with a laser light beam according to image data to form a latent image thereon. The development device A3 develops the latent image into a visible toner image.

The image forming unit A further includes an intermediate transfer device A4 and a transfer device A5 near the photoconductive drums A1. Toner images formed on the photoconductive drums A1 are transferred and superimposed one atop another on the intermediate transfer device A4 as a color toner image. Then, transfer device A5 transfers the color toner image onto a recording medium P.

A cleaner A6 is disposed in such a position as to remove and collect residual toner that fails to be transferred onto the intermediate transfer device A4 and therefore remaining on the surface of the photoconductive drum A1 from the surface of the photoconductive drum A1. Similarly, a cleaner A16 is disposed in such a position as to remove and collect residual toner that fails to be transferred onto the recording medium P and therefore remaining on the surface of the intermediate transfer device A4 from the surface of the intermediate transfer device A4. A cleaner A26 is disposed in such a position as to remove and collect residual toner from the transfer device A5. A lubricant supply unit A7 is disposed near the cleaner A6 to reduce a coefficient of friction on the surface of the photoconductive drum A1 serving as a first image carrier. Similarly, a lubricant supply unit A17 is disposed near the cleaner A16 to reduce a coefficient of friction on the surface of the intermediate transfer device A4 serving as a second image carrier. A lubricant supply unit A27 is disposed near the cleaner A26 to reduce a coefficient of friction on the surface of the transfer device A5. The recording medium P carrying the color toner image is conveyed from the transfer device A5 to the fixing device 1 that is located downstream from the transfer device A5 in a direction in which the recording medium P is conveyed along the recording medium conveyance passage E.

To facilitate maintenance, each of the photoconductive drums A1 and the surrounding components such as the charger A2, the development device A3, the cleaner A6 and the lubricant supply unit A7 are incorporated in a process cartridge (PC) that is removable from the image forming apparatus 100 as a unit. In a similar manner, the cleaner A16 and the lubricant supply unit A17 are provided as a unit and removable from the intermediate transfer device A4. The cleaner A26, the lubricant supply unit A27, and a transfer roller used as the transfer device A5 are provided as a unit and removable from the image forming apparatus 100.

The recording medium P passing through the fixing device 1 is discharged to the discharge unit D via a pair of discharge rollers A9. Thus, recording media P are stocked in the discharge unit D.

A detailed description is now given of conveyance of the recording medium P to the image forming device A.

The feed unit B accommodates a plurality of unused recording media P. As a feed roller B1 rotates, it picks up an uppermost recording medium P of the plurality of recording media P placed on a tray, and feeds the recording medium P toward a pair of registration rollers A11. The pair of registration rollers A11 temporarily stops conveyance of the recording medium P and starts rotation to convey the recording medium P such that the color toner image can be transferred from the intermediate transfer device A4 onto the recording medium P between the intermediate transfer device A4 and the transfer device A5.

In the scanner C, a moving body C1 including a light source and a mirror reciprocates to scan a document placed on a contact glass C2. Image data scanned by the moving body C1 is read by a charge coupled device (CCD) C4 disposed behind a lens C3 as image signals.

The image signals thus read are digitized for image processing. According to the processed signals, the exposure device A10 irradiates the surface of the respective photoconductive drums A1 with laser light beams (optical signals) emitted by a laser diode to form latent images thereon. The optical signals from the laser diode reach the respective photoconductive drums A1 via, e.g., a polygon mirror and a lens.

The charger A2 mainly includes a charging member and a biasing member that presses the charging member against the photoconductive drum A1 at a predetermined pressure. The charging member has a conductive shaft surrounded by a conductive elastic layer. A power source applies a predetermined voltage between the conductive elastic layer and the photoconductive drum A1 via the conductive shaft to charge the surface of the photoconductive drum A1.

The development device A3 agitates developer with an agitation screw sufficiently to attach the developer to a development roller magnetically. A development doctor blade forms the developer thus attached into a thin layer on the development roller. With the thin layer of developer, the latent image formed on the photoconductive drum A1 is developed as a visible toner image.

A transfer bias roller electrically transfers the toner image onto the intermediate transfer device A4, which is an intermediate transfer belt in the present embodiment. The cleaner A6 removes the residual toner that fails to be transferred onto the intermediate transfer device A4 from the surface of the photoconductive drum 1. The lubricant supply unit A7 includes a lubricant supply roller A71, a solid lubricant A72, and a biasing member A73. The lubricant supply roller A71 is a brush roller having a metal shaft which bristles are wound around.

The lubricant supply roller A71 presses against the solid lubricant A72 by its own weight. The biasing member A73 biases the solid lubricant A72 against the lubricant supply roller A71. As the lubricant supply roller A71 rotates, it scrapes off the solid lubricant A72 as fine powder to supply the fine powder of the solid lubricant A72 onto the surface of the photoconductive drum A1. The solid lubricant A72 is supplied onto substantially the entire surface of the photoconductive drum A1, which is wider than a cleaning area of the cleaner A6.

This is because the solid lubricant A72 is supplied onto an entire area of the surface of the photoconductive drum A1 where the cleaning blade of the cleaner A6 contacts, while an effective cleaning area is determined based on, e.g., cleaning performance of the cleaner A6.

As in the lubricant supply unit A7, a lubricant supply unit A17 includes a lubricant supply roller A171, a solid lubricant A172, and a biasing member A173. The cleaner A16 and the lubricant supply unit A17 are disposed in a housing as a unit herein called a transfer cartridge. The biasing member A173 biases the solid lubricant A172 against the lubricant supply roller A171 that is a brush roller at a predetermined pressure. As the lubricant supply roller A171 rotates, it scrapes off the solid lubricant A172 as fine powder to supply the fine powder of the solid lubricant A172 onto the surface of the intermediate transfer device A4. The cleaner A16 is disposed upstream from the lubricant supply unit A17 in a direction Y in which the intermediate transfer device A4 rotates. The cleaner A16 includes a brush roller and a cleaning blade that clean the intermediate transfer device A4.

The brush roller of the cleaner A16 rotates in the same direction as the direction Y to diffuse foreign substances on the surface of the intermediate transfer device A4. The cleaning blade of the cleaner A16 contacts the intermediate transfer device A4 at a predetermined angle at a predetermined pressure to remove the residual toner from the surface of the intermediate transfer device A4.

As in the lubricant supply units A7 and A17, a lubricant supply unit A27 includes a lubricant supply roller A271, a solid lubricant A272, and a bias member A273. The biasing member A273 biases the solid lubricant A272 against the lubricant supply roller A271. The lubricant supply roller A271 scrapes off the solid lubricant A272 as fine powder to supply the fine powder of the solid lubricant A272 onto the surface of the transfer device A5. The transfer device A5 and the cleaner A26 are provided as a unit herein called a transfer cartridge. The cleaner A26 is disposed as illustrated in FIG. 1 to remove the residual toner from the transfer device A5.

Figure 2:
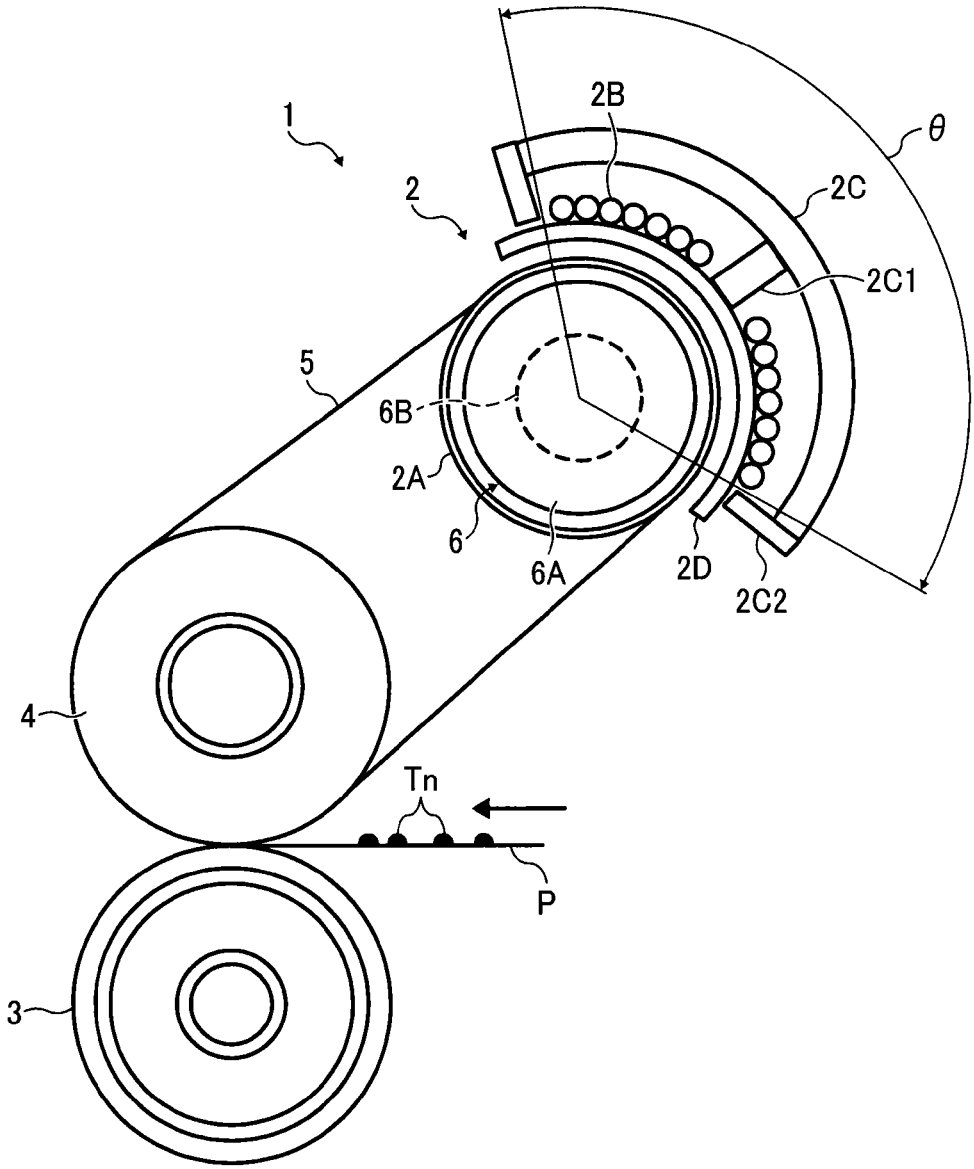
FIG. 2 is a schematic view of a fixing device incorporated in the image forming apparatus of FIG. 1.

Referring now to FIG. 2, a description is given of a construction of the fixing device 1 incorporated in the image forming apparatus 100 described above.

FIG. 2 is a schematic view of the fixing device 1. In the present embodiment, the fixing device 1 employs a fixing belt 5 to fix a toner image on a recording medium. Specifically, the fixing device 1 includes a heat generator 2, a pressing roller 3, a fixing roller 4 disposed facing the pressing roller 3 to abut against the pressing roller 3, and the fixing belt 5. The heat generator 2 includes a heating roller 2A as a rotatable heater. The fixing belt 5 is entrained around the heating roller 2A and the fixing roller 4 and between the pressing roller 3 and the fixing roller 4.

The heat generator 2 further includes an excitation coil 2B, an arch core 2C, and a coil supporter 2D outside the heating roller 2A.

Figure 3:
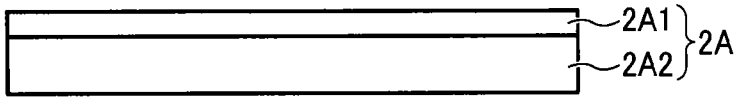
FIG. 3 is a schematic partial sectional view of a heating roller incorporated in the fixing device of FIG. 2.

Referring now to FIG. 3, a detailed description is given of a construction of the heating roller 2A, which is, in the present embodiment, used to heat a toner image via the fixing belt 5.

FIG. 3 is a schematic partial sectional view of the heating roller 2A. As illustrated in FIG. 3, the heating roller 2A is constructed of a heat generation layer 2A1 and a thermosensitive magnetic body 2A2. The excitation coil 2B generates a magnetic flux and inductively heat the heat generation layer 2A1, allowing the heat generation layer 2A1 to generate heat. The thermosensitive magnetic body 2A2 faces the excitation coil 2B via the heat generation layer 2A1.

The heat generation layer 2A1 is a conductive plated layer such as a copper (Cu) layer provided on an outer circumferential surface of the heat generation layer 2A1 to facilitate generation of eddy currents and enhance heat generation efficiency.

The thermosensitive magnetic body 2A2 is made of a magnetic shunt alloy containing, e.g., iron and nickel, the composition of which is adjusted so that the thermosensitive magnetic body 2A2 has a Curie temperature of, e.g., about 100° C. to about 300° C. The thermosensitive magnetic body 2A2 switches between magnetized and demagnetized states at a temperature defined by a Curie temperature, thereby controlling the magnetic permeability through the heat generation layer 2A1 to selectively create localized heating areas in the heat generation layer 2A1. In the present embodiment, the thermosensitive magnetic body 2A2 is a roller. Alternatively, the thermosensitive magnetic body 2A2 may be a film or an endless belt.

Accordingly, the fixing belt 5 is just a substance made of a polyimide resin, without a heat generation layer. Although the fixing belt 5 does not include a heat generation layer, the fixing belt 5 is heated by the heating roller 2A to a predetermined temperature.

Figure 4:
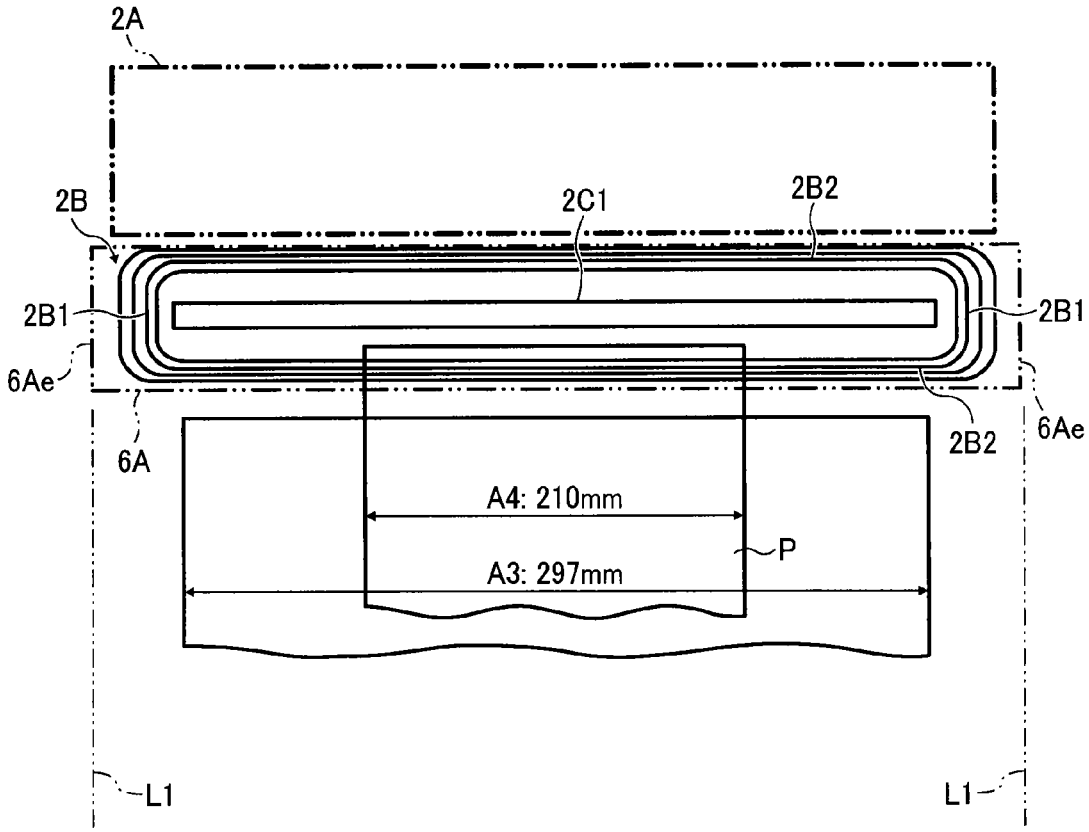
FIG. 4 is a diagram illustrating relative positions of an excitation coil, a center core, and the support shaft.

Referring now to FIG. 4, a detailed description is given of a configuration of the exciting coil 2B.

FIG. 4 is a diagram illustrating relative positions of the excitation coil 2B, the center core 2C1, and a support shaft 6. As illustrated in FIG. 4, the excitation coil 2B includes turning ends 2B1 and extended portions 2B2 continuous with the turning ends 2B1. Each of the extended portion 2B2 has a length sufficient to cover an entire width of a largest size of recording medium, in this case of A3 (297 mm), carrying a toner image to be fixed thereon.

A detailed description is now given of a configuration of the arch core 2C.

As illustrated in FIG. 2, the arch core 2C is provided with a centrally located center core 2C1 and an end core 2C2 at each end of the arch core 2C. The excitation coil 2B is wound around the center core 2C1 as specifically illustrated in FIG. 4.

The fixing device 1 is driven at high frequency by an inverter connected to the excitation coil 2B to generate a high-frequency field (magnetic flux) that generates the eddy currents flowing in the heat generation layer 2A1 of the heating roller 2A, thereby increasing the temperature of the heating roller 2A.

While a recording medium P carrying toner Tn passes between the pressing roller 3 and the fixing belt 5 that is stretched around the heating roller 2A and the fixing roller 4, the toner Tn facing the fixing belt 5 melts and penetrates the recording medium P under heat and pressure.

A detailed description is now given of a configuration of the pressing roller 3.

The pressing roller 3 also serves as a roller that drives the fixing belt 5. Specifically, the pressing roller 3 rotates the fixing belt 5 while conveying the recording medium P between the pressing roller 3 and the fixing roller 4 via the fixing belt 5. Thus, in the present embodiment, the pressing roller 3 is provided with a drive source. Alternatively, the fixing belt may be provided with a drive source.

Some image forming apparatus may employ electromagnetic induction heating. Unlike a typical fixing method using a heating roller, the electromagnetic induction heating method enables heat generation by eddy currents that are generated on a fixing member such as a roller or a belt, without a heating mechanism such as a heating roller. Accordingly, the fixing member can be a heating source, and there is an advantage of shortening the heating time.

In electromagnetic induction heating, a relatively thin heat generation layer used as a heat generator may cause uneven temperature distribution of the fixing member, specifically, in a longitudinal direction of the fixing roller or in a width direction of the fixing belt.

If a recording medium such as a recording sheet is conveyed centrally in the longitudinal direction of the fixing roller or in the width direction of the fixing belt, the recording medium may draw heat from a contact region of the fixing roller or the fixing belt that contacts the recording medium, while non-contact regions at both ends of the fixing roller or the fixing belt that do not contact the sheet maintain heat and may be excessively heated.

To prevent such excessive heating at the non-contact regions of the fixing member, there are provided fixing devices that use a degausser, e.g., between a thermosensitive magnetic metal and a heat generator such as an excitation coil. In an induction heating configuration using the thermosensitive magnetic metal, a shorter interval between the thermosensitive magnetic metal and the heat generator enhances the heat generation efficiency.

In the present embodiment, the support shaft 6, which supports opposed ends of the heating roller 2A axially, parallel to a direction in which the excitation coil 2B extends, doubles as a degausser, thereby obviating the need for a separate degausser.

The support shaft 6 is made of a nonmagnetic material such as aluminum or an alloy of aluminum having a lower electrical resistivity than the thermosensitive magnetic body 2A2, and is used as a degausser to cover an area wider than at least an area in which the excitation coil 2B is wound around (i.e., an area having an angle θ in FIG. 1). The support shaft 6 generates the eddy currents by receiving a transmissive magnetic flux when the thermosensitive magnetic body 2A2 selectively creates localized heating areas in the heat generation layer 2A1.

Figure 5:
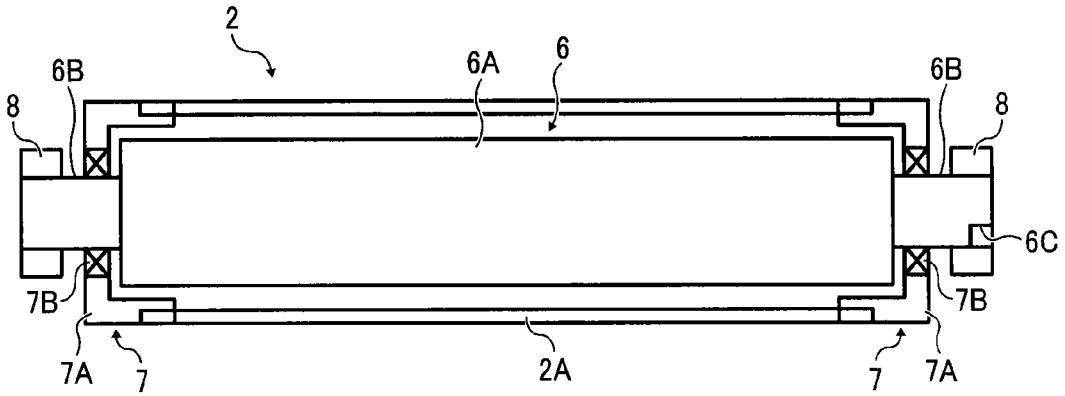
FIG. 5 is a sectional view of principal parts of the heating roller and a support shaft for the heating roller serving as a degausser.

FIG. 5 is a sectional view of principal parts of the heating roller 2A and the support shaft 6. In FIG. 5, the heating roller 2A included in the heat generator 2 has a flange 7 at each end axially along the heating roller 2A. The flange 7 is rotatably supported by the support shaft 6. The support shaft 6 includes a body portion positioned inside the heating roller 2A and support portions positioned at the flanges 7 of the heating roller 2A. In other words, the support portions are outboard of and continuous with opposed lateral ends of the body portion, and supports the heating roller 2A. The body portion and the support portions differ in outer diameter axially along the support shaft 6.

In the present embodiment, the body portion of the support shaft 6 is referred to as a largest outer diameter portion 6A. Each of the support portions of the support shaft 6 is referred to as a smallest outer diameter portion 6B.

The largest outer diameter portion 6A of the support shaft 6 faces the excitation coil 2B via the heating roller 2A across an interval ranging from about 3.2 mm to about 6.2 mm in a sectional direction, to enhance degaussing effectiveness and avoid contact with the heating roller 2A. Particularly, an interval of about 6.2 mm is the largest interval sufficient to enhance degaussing effectiveness and avoid contact with the heating roller 2A, when 230° is an upper limit of temperature for protecting components in the non-contact regions of the fixing roller 4 or the fixing belt 5.

The difference between the largest outer diameter portion 6A and the smallest outer diameter portions 6B is selected from about 1 mm to about 10 mm while the largest outer diameter portion 6A has an outer diameter of from about 31 mm to about 34 mm. Preferably, the difference between the largest outer diameter portion 6A and the smallest outer diameter portions 6B is about 5 mm, while the largest outer diameter 6A has an outer diameter of about 32 mm to downsize the fixing device 1.

Referring back to FIG. 4, which includes an illustration of a relationship between the excitation coil 2B and the largest outer diameter portion 6A positioned inside the heating roller 2A that face each other, each end 6Ae of the largest outer diameter portion 6A is positioned outside the corresponding turning end 2B1 of the excitation coil 2B axially along the support shaft 6, as indicated by line L1.

In the present embodiment, each end 6Ae of the largest outer diameter portion 6A is positioned outside the corresponding turning end 2B1 of the excitation coil 2B across an interval ranging from about 0.5 mm to about 10 m, and preferably, across an interval of about 1 mm. Accordingly, the largest outer diameter portion 6A of the support shaft 6 is not unnecessarily lengthened, thereby contributing to downsizing of the fixing device 1.

In the present embodiment, the support shaft 6 has the largest outer diameter portion 6A and the smallest outer diameter portions 6B. Alternatively, the support shaft 6 may have three or more portions of differing diameters.

The junctions between portions of different diameters of the support shaft 6 may be continuous (i.e., inclined) or discontinuous (i.e., stepped). Preferably, as illustrated in FIG. 5, the junctions are stepped.

If the support shaft 6 has three portions of differing diameters (e.g., large, middle, and small portions), the middle portion of the support shaft 6 preferably has a length as small as possible axially, to downsize the fixing device 1.

In FIG. 5, the support shaft 6 is supported at the smallest outer diameter portions 6B by bearings 8 provided in a housing of the fixing device 1. To prevent rotation, a flat portion 6C is formed in a part of one of the smallest outer diameter portions 6B that is supported by the corresponding bearing 8.

The flange 7 provided at each end of the heating roller 2A axially along the heating roller 2A includes a receiving portion 7A as an integral part of the heating roller 2A, and a bearing portion 7B embedded in the smallest outer diameter portion 6B. The receiving portion 7A is supported by the bearing portion 7B rotatably about the support shaft 6.

In the present embodiment, the above-described configuration obviates the need for providing any special degausser between the excitation coil 2B and the thermosensitive magnetic body 2A2 of the heating roller 2A. In other words, an existing component (i.e., the support shaft 6 for the heating roller 2A) is used as a degausser.

Since no degausser is provided separately from a support member (i.e., support shaft 6) of the heating roller 2A in the present embodiment, the fixing device 1 can be downsized.

Additionally, in the present embodiment, the heat generator 2 includes the heat generation layer 2A1, thereby obviating the need for providing the fixing belt 5 with a heat generation layer. Accordingly, the fixing belt 5 has a simple configuration, reducing production costs.

Since the support shaft 6 serves as a degausser and the ends 6Ae of the largest outer diameter portion 6A are positioned outside the turning ends 2B1 of the excitation coil 2B, there is no need for space to allow the degausser to move. In addition, the entire axial area of the support shaft 6 can prevent excessive heating in the non-contact regions of the fixing roller 4 or the fixing belt 5.

Moreover, the support shaft 6 serving as a degausser reduces changes in interval between the support shaft 6 and the excitation coil 2B, and prevents decrease in the heat generation efficiency and degaussing efficiency.

The present invention has been described above with reference to specific exemplary embodiments. It is to be noted that the present invention is not limited to the details of the embodiments described above, but various modifications and enhancements are possible without departing from the scope of the invention. It is therefore to be understood that the present invention may be practiced otherwise than as specifically described herein. For example, elements and/or features of different illustrative exemplary embodiments may be combined with each other and/or substituted for each other within the scope of this invention. The number of constituent elements and their locations, shapes, and so forth are not limited to any of the structure for performing the methodology illustrated in the drawings.

What is claimed is:

1. A fixing device comprising:

an excitation coil on a core to generate a magnetic flux, comprising:

a turning end; and an extended portion continuous with the turning end;

a rotatable heater comprising:

a heat generation layer to generate heat with the magnetic flux from the excitation coil; and a thermosensitive magnetic body disposed facing the excitation coil via the heat generation layer, composed to switch between magnetized and demagnetized states at a temperature defined by a Curie temperature to selectively create localized heating areas in the heat generation layer; and a support shaft made of a nonmagnetic material having a lower electrical resistivity than the thermosensitive magnetic body to support opposed ends of the heater axially along the heater parallel to a direction in which the excitation coil extends, the support shaft comprising:

a body portion positioned inside the heater, having a largest outer diameter of the support shaft and an end positioned outside of both the turning end of the excitation coil and an end of the core; and support portions outboard of and continuous with opposed lateral ends of the body portion, having a smallest outer diameter of the support shaft different from the largest outer diameter, and supporting the heater.

2. The fixing device according to claim 1, further comprising bearings to support the support portions of the support shaft, wherein the bearings support the opposed ends of the heater axially along the heater rotatably about the support portions of the support shaft.

3. The fixing device according to claim 1, wherein the heat generation layer of the heater faces the excitation coil and is a conductive plated layer.

4. The fixing device according to claim 1, wherein the heat generation layer is made of copper.

5. The fixing device according to claim 1, wherein the thermosensitive magnetic body comprises one of a roller, a film, and an endless belt.

6. The fixing device according to claim 1, wherein the body portion of the support shaft faces the excitation coil via the heater across an interval ranging from about 3.2 mm to about 6.2 mm in a sectional direction.

7. An image forming apparatus comprising:

an image forming unit to form an image on a recording medium; and the fixing device according to claim 1 to fix the image on the recording medium.

* * * * *